US005575503A

United States Patent [19]

Takahashi

[11] Patent Number: 5,575,503

[45] Date of Patent: Nov. 19, 1996

[54] FILING TOOL

[75] Inventor: Masakatsu Takahashi, 4-6, Narihira-cho, Ashiya-shi, Hyogo 659, Japan

[73] Assignees: Masakatsu Takahashi; Toki Takahashi, both of Hyogo; Ryutaro Takahashi; Megumi Hashimoto, both of Tokyo; Chizuko Yamada, Niigata; Kentaro Takahashi, Shiga, all of Japan

[21] Appl. No.: 150,042

[22] PCT Filed: Aug. 5, 1992

[86] PCT No.: PCT/JP92/01010

§ 371 Date: Nov. 17, 1993

§ 102(e) Date: Nov. 17, 1993

[87] PCT Pub. No.: WO93/18926

PCT Pub. Date: Sep. 30, 1993

[30] Foreign Application Priority Data

Mar. 17, 1992 [JP] Japan ..... 4-092285

[51] Int. Cl.[6] ..... B42D 1/00

[52] U.S. Cl. ..... 281/21.1; 281/28; 281/29; 281/36; 281/51; 281/DIG. 1

[58] Field of Search ..... 281/28, 51, DIG. 1, 281/29, 21.1, 36, 15.1

[56] References Cited

U.S. PATENT DOCUMENTS

| | | | |
|---|---|---|---|
| 3,145,326 | 8/1964 | McGannon | 281/DIG. 1 |
| 3,398,328 | 8/1968 | Piekanski | 335/2 |
| 5,328,206 | 7/1994 | Scott | 281/DIG. 1 |

FOREIGN PATENT DOCUMENTS

| | | | |
|---|---|---|---|
| 1093104 | 5/1955 | France | 281/DIG. 1 |
| 631466 | 11/1949 | United Kingdom | 281/DIG. 1 |

*Primary Examiner*—Willmon Fridie, Jr.
*Attorney, Agent, or Firm*—Antonelli, Terry, Stout & Kraus

[57] ABSTRACT

A filing tool (1) for filing one or more sheets 6 provided with a magnetically attractable area (7) on a side end or periphery of the sheet is composed of a two-folded cover member (2) having a back (2*a*), an electromagnet (3) situated along the back (2*a*), an and an ON-OFF switch (5) for changing "ON" to "OFF" or "OFF" to "ON" for flowing a current to the electromagnet (3). Thereby, the sheet can be readily attracted by the cover member and can be readily detached therefrom by operating the ON-OFF switch. Further, even an intermediate sheet can be easily picked up.

2 Claims, 9 Drawing Sheets

FILING TOOL

DESCRIPTION

1. Technical Field

The present invention relates to a magnetic filing device, and more particularly, to a filing tool capable of easily filing and detaching operation.

2. Background Art

There has hitherto been known a type of filing tool 75 shown in FIG. 11. The filing tool 75 has a pair of holes 72 of a sheet 71 for the use of filing (a paper in generally used as the sheet 71) and a fitting 74 for fastening the tapes 73. Another type of a known filing tool has a pair of rings capable of closing/opening to be inserted through a pair of holes 72 of the above-mentioned sheet 71. Further, as shown in FIG. 12, a filing tool 83 having a clamp 82 biased by a spring 81 against a cover sheet so as to clamp sheets 71, and such a filing device, wherein many transparent envelopes are filed like a notebook, so as to allow for detachably inserting the sheets therein are also known.

Further, a scrapbook for pasting newspaper clippings or the like is also known.

However, the above-mentioned filing tools have some problems which the user feels are very troublesome. For instance, the bar-like fitting 74 or rings require excessive time for punching holes in the sheets and time for inserting the tapes 73 or rings through the holes 72 of many sheets. The filing tool 83 having the clamp 82 is troublesome for opening/closing the clamp 82 against force of the spring 81. Further, when the force of spring 81 is weak, some sheets may easily slip out. For instance, even if the user intends to take off only one sheet of paper, the remainders become scattered by all means.

Further, the tool having the transparent envelopes and scrapbook are not convenient, since the user must insert each sheet to a respective envelope or paste each of the sheets one by one.

The main object of the present invention is to delete the inconvenience of the above mentioned conventional filing tools, and to provide a filing tool with which it is easy to file sheets and with which ar can easily attach/detach either many sheets or only one sheet or so.

DISCLOSURE OF THE INVENTION

According to the present invention, there is provided a filing tool comprising a magnet and a cover member which is provided with said magnet.

The magnet can be a permanent magnet.

Further, the magnet can be an electromagnet.

Furthermore, the electromagnet preferably includes a slide rheostat.

Furthermore, the electromagnet preferably includes means for switching the magnetically attracting means between excited (magnetized) and non-excited (demagnetized) states.

The word "non-excited state" includes such a state that there remains weak magnetic force. In such a case, the switching means changes the magnetic force of the magnetic attracting means between "excited state" and "non-excited state".

The electromagnet preferably includes an electric cell or battery for exciting the electromagnet, and an on-off switch or the like is preferably used as the switching means which is installed between the cell and the electromagnet.

Further, it is preferable that the electromagnet includes a connecting means for connecting with an AC power source, an the on-off switch is installed between the connecting means and the electromagnet.

It is preferable that the electromagnet is secured to the bracket detachably connected to the cover member.

Further, it is preferable that the cover member is provided with the electromagnet in a manner as to be located at the back of the cover member.

Besides, the cover member is used in a manner as to completely cover both sides of the sheet to be filed, or as to abut one side of the sheet to a board. The cover member is preferably provided with a two-folded sheet with magnetic shield property.

Further, according to the second aspect of the present invention, there is provided a magnetically attractable sheet to be filed in the above mentioned filing tool. The magnetically attractable sheet comprises a sheet, such as paper, plastic sheet or the like, and a magnetically attractable area or band to be easily magnetically attracted and released by a magnet. The magnetically attractable band is formed on a side end of the sheet.

The magnetically attractable band can be made by applying a blend of binder or binding agent and powder of easily-changeable-material and then drying it up. The word "easily-changeable-material" means a material such as a ferromagnetic which can be easily magnetized when it is put in a magnetic field, and can be easily demagnetized at the outside of the magnetic field. For example, metal such as ferrite is useful as the easily-changeable-material. Further, the word "binder" includes glue, paste, starch, gum, bond or the like. Further, another type of magnetically attractable band can be obtained by bonding a tape made of the above mentioned easily-changeable-material, or a tape on which the powder of easily-changeable-material is applied with binder on the side end of the sheet.

Such a magnetically attractable sheet is combined with the above mentioned filing tool in use, and a filing device can be obtained.

In the above mentioned filing tool according to the first aspect of the present invention, when a user intends to file the magnetically attractive sheet on the cover member in a manner as to be arranged in order, the magnetically attractive sheet is attracted by the magnetically attractive means of the filing tool. Then, the sheets are filed so as not to be loosened.

If the magnet is an electromagnet including a slide rheostat or a switching means for turning between "excited state" and "non-excited state", when a user intends to file the sheet, he operates the slide rheostat or the switching means to turn into "non-excited (or "weak")" state, puts and arranges the magnetically attractable sheets to be filed on the cover member. Then, he changes the slide rheostat or the switching means into "excited (or "strong")" state. Hence, the sheets are attracted by the magnetically attracting means and are filed so as not to be loosened.

When a sheet or sheets are detached, the user turns over the pages of the filed sheets and searches for the sheet to be detached. Then, pinching the sheet with his/her fingers, the user changes the switching means for the magnetic attracting means to the "non-excited (or "weak")" state or position. After the sheet is released, the switching means is turned to the "excited (or "strong")" position or state again.

As mentioned above, the filing tool of the present invention utilizes magnetic force of the magnetic attracting means as a force for binding many sheets without mechanical engagement or rings, straps, or the like. Therefore, a pair of punch holes is not required in the sheet. Further, the switching means of the filing tool does not require strong operational force in comparison with the spring-type clamp of the conventional device.

The filing tool having a switching means for changing magnetic attracting force between "strong" and "weak" state such as the slide rheostat has an additional advantage. That is to say, when one or several sheets are detached from the filing tool, the remainders are still held with the weak attracting force of the attracting means, and do not become scattered.

BEST MODE FOR CARRYING OUT THE INVENTION

Hereinafter, the magnetic filing tool of the present invention is explained with reference to the accompanying drawings.

Figure 1:
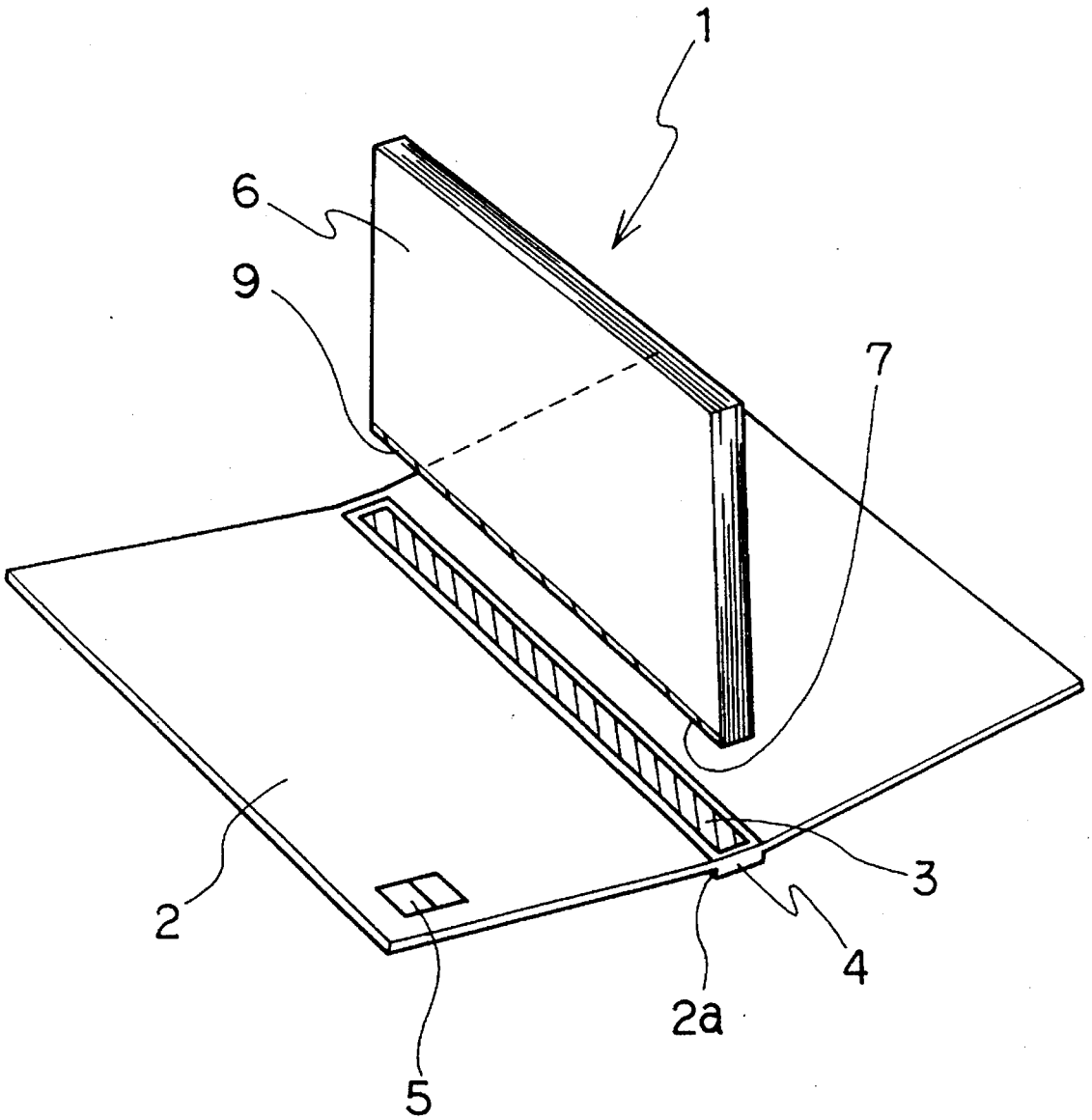
FIG. 1 is a perspective view showing an embodiment of the filing tool of the present invention.

Referring to FIG. 1, a filing tool 1 comprises a cover 2 made of a folded sheet with a back 2*a*, an electromagnet 3 accomodated in the back 2*a*, a cell 4 for supplying electric current to the electromagnet 3 and an on-off switch 5. The electromagnet 3 has a bar-like core wrapped by a coil. The core is made of easily-changeable-material or soft-magnetic materials having high permeability and less magnetic hysteresis loss, for example, ferrite, silicon steel, ferrosilicon, ferronickel alloy, another type of alloy, ferrite oxide, and the like.

Though the on-off switch 5 is fixed on the internal face of the cover 2 in the embodiment of FIG. 1, the on-off switch 5 might be attached on any portion where it is convenient to operate the switch, for example, on the outside of the cover 2, on the back 2*a* of the cover 2, and the like.

Numeral 6 in FIG. 1. A plurality of the sheets are shown in FIG. 1. designates a sheet of paper to be filed in the filing tool 1. The paper 6 is provided with a magnetically attractable area or band 7 at a side end thereof. That is, the paper 6 is a magnetically attractable sheet of the present invention. The magnetic band 7 is formed by applying and drying up binder, glue, bonding agent blended with powder of easily-changeable-material such as ferrite. Further, the magnetic band 7 can also be formed by bonding a tape of easily-changeable-material, for example a metal tape made of silicon steel, or by bonding a tape obtained by applying the above mentioned blend or binder, glue or bond with a powder of the easily-changeable-material on the side end of the sheet.

In addition, the cover 2 is made of a magnet shield sheet capable of shielding against lines of magnetic force around the electromagnet 3. As the shield sheet, there are given a pulp paper including metal fibers, a synthetic resin sheet or film laminated or molded with a metal foil or metal fibers, and a shield layer of a metal race or metal fabric like a shield layer used in an electric cord or cable.

When the sheets of paper 6 are filed in the filing tool 1, the switch 5 is turned off to demagnetize the electromagnet 3. Then the sheets of paper 6 are put on the filing tool 1 so as to abut the marginal edge in the side of the magnetically attractable band 7 of the sheet of paper 6 against the electromagnet 3, and the switch 5 is turned on. Then, the attractable band 7 is attracted by the electromagnet 3. After that, the cover 2 is closed so that the sheets of paper are accomodated. Thereafter, the back 2*a* of the cover 2 may be clamped by a clamping means such as a clip and a spring. Thus, magnetically attractable sheets do not become scattered, even if the cell is consumed.

As another manner, the sheets of paper 6 might be fallen through a gap between other sheets of paper already fixed in the tool, after the cover 2 is almost closed with the switch 5 being turned on. In this case, the magnetic poles of the magnetically attractable bands 7 of the already filed paper 6 are the same magnetic pole, and then, those sheets of paper 6 are not contacted with each other closely. Therefore, the new paper 6 can be easily inserted through the gap between the sheets which are already filed papers. When a filed paper is taken, firstly the cover 2 is opened. Then, the switch 5 is turned off and the aimed paper 6 is taken out. Finally, the switch is turned on again to hold remainders in the tool 1.

In the embodiment of FIG. 1, an on-off switch 5 is employed as a switching means. However, a switch for changing the voltage to be applied to the electromagnet between "high" and "low" states can be used. In this case, the attractable paper 6 can be easily attached/detached by changing the magnetic force of the electromagnet. In order to make magnetic field remain to some extent even if the switch is turned off, the above-mentioned electromagnet may be combined with the permanent magnet so as to change the magnetic force between "high" and "low" states. As mentioned above, according to this embodiment, the electromagnet was supplied with electric current by means of the cell. However, the cell can be replaced by an alternating current (AC) power supply. Then, AC is rectified by a rectifier (or a converter), which is stored in the back 2*a* of the cover 2, so that the electromagnet can be supplied with direct current. In this case, changing the voltage to be applied to the electromagnet between "high" and "low" state can be achieved by changing the resistance of a small slide rheostat which is stored in the back 2*a*.

In the embodiment of FIG. 1, lines of magnetic force are gathered to the side edge of the paper 6, and all magentic bands 7 of the paper 6 are held by the electromagnet 3. Therefore, the force for holding the paper 6 is large. However, the present invention is not limited to this type of filing tool and attractable sheet.

Figure 2:
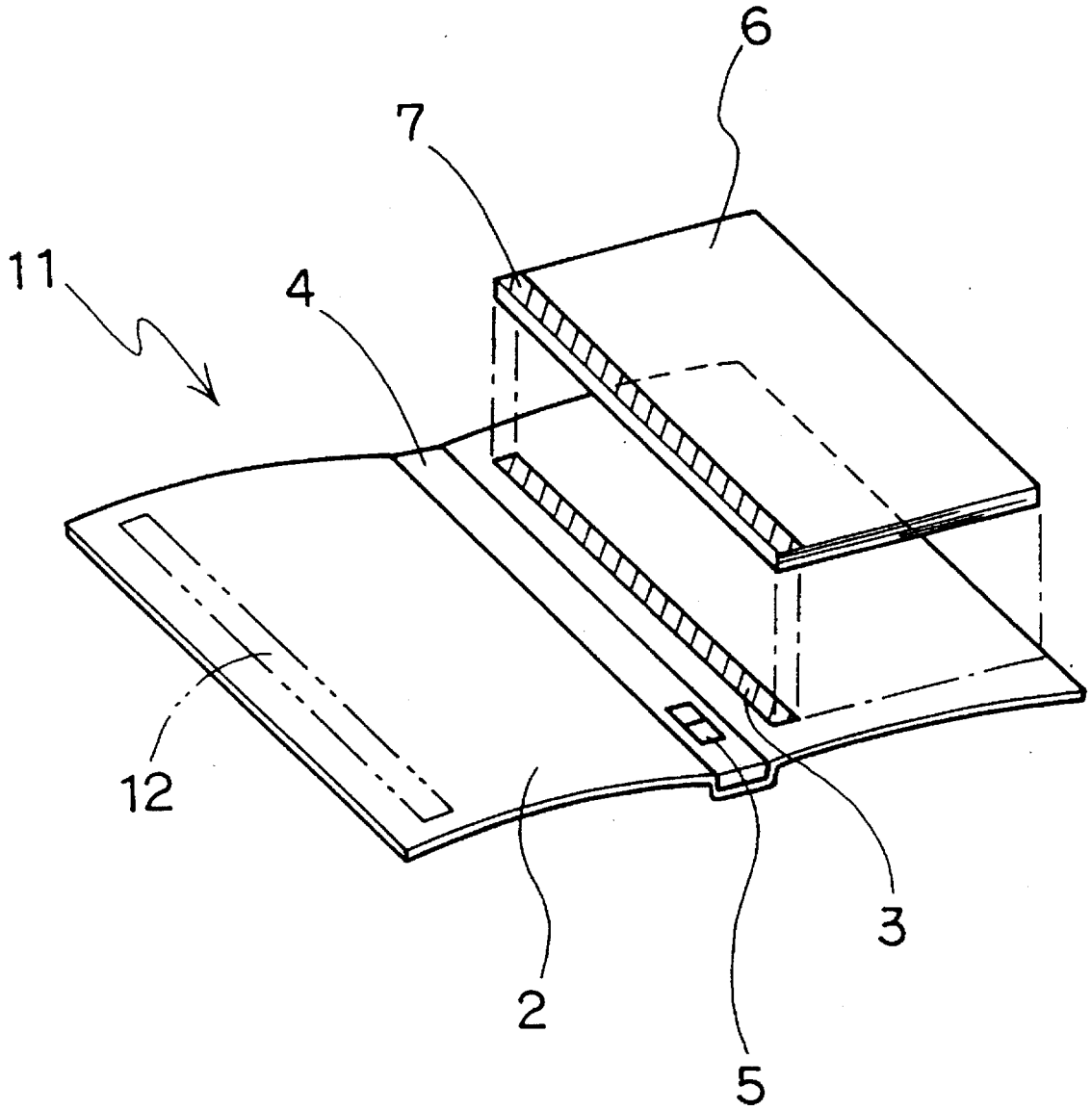
FIG. 2 is a perspective view showing another embodiment of the filing tool of the present invention.

FIG. 2 shows another embodiment of filing tool 11. The filing tool 11 is provided with an electromagnet 3 inside of the cover so that the electromagnet extends near and along the fold line of the back 2*a* of the cover 2. Therefore, the magnetic field force acts through the plural leaves of paper 6.

In addition, the filing tool 11 of FIG. 2 has a bar-like permanent magnet 12 extending along the free end of the cover 2. The permanent magnet 12 is a tool for temporarily fastening a piece of paper for memorandum or the like having a magnetically attractable band.

Figure 3:
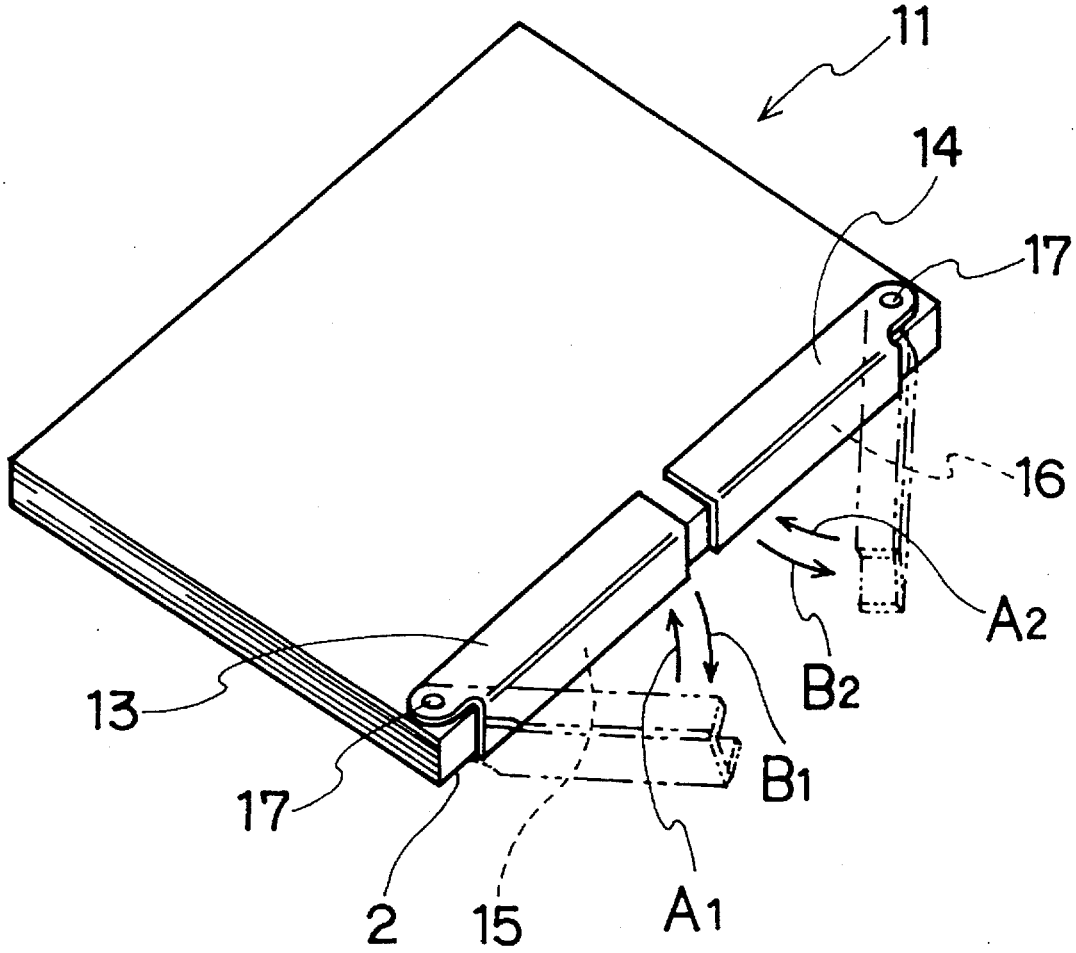
FIG. 3 is a perspective view showing still another embodiment of the filing tool of the present invention.
Figure 4:
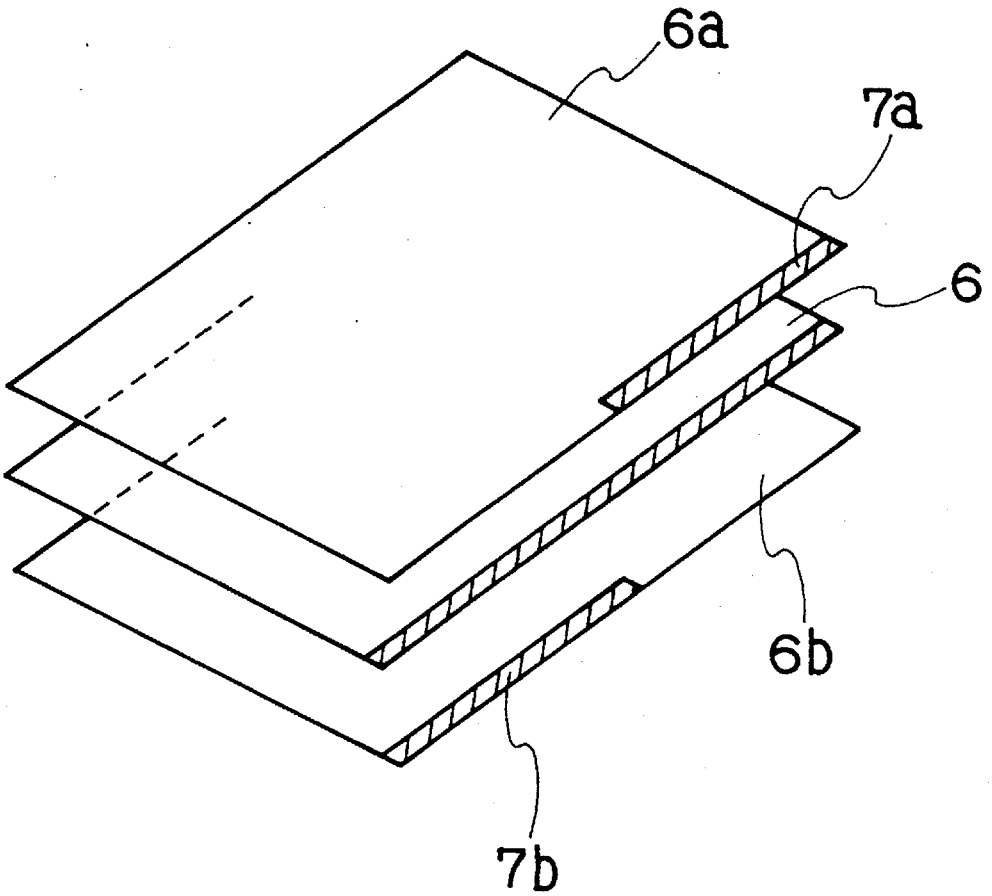
FIG. 4 is a perspective view showing an embodiment of the magnetically attractable sheet of the present invention.

Referring to FIG. 3, the filing tool 11 is provided with a pair of brackets 13, 14 with "C"-like-shaped cross section. Each end of the bracket 13, 14 is rotatably jointed to the upper and lower end of the back 2*a* of the cover 2 so that the bracket 13, 14 turns between a position (real line) in contact with the back 2*a* and a position (phantom line) apart from the back 2*a*.

Further, each bracket 13, 14 has a respective permanent magnet 15, 16 fixed therein. In this embodiment, the rotatable brackets 13, 14 are means for performing the same function of switching between excited state and non-excited state. Besides, the numeral 17 designates a pin or eyelet. That is to say, when the brackets 13, 14 are rotated in the direction of arrows A1 and A2, respectively, to abut the back 2*a* of the cover 2, an excited state that the papers 6 are magnetically attracted is obtained. And when those brackets 13, 14 are rotated in the directions of arrows B1 and B2 to be released, a non-excited state is obtained.

In the above mentioned case that the magnetically attracting means comprises two or more magnets so that each attracting means can be switched between excited and non-excited states, it is convenient to employ three kinds of sheets composed of the upper paper 6*a* having a magnetically attractable band 7*a* at the upper half portion, the lower paper 6*b* having a magnetically attractable band 7*b* at the lower half portion, and the middle paper 6 which is a normal magnetically attractable paper having a full length of magnetically attractable band 7. By selecting the bracket or brackets 13, 14 to be opened, the sheets capable of being taken out can be determined so as to be smoothly searched.

Figure 5:
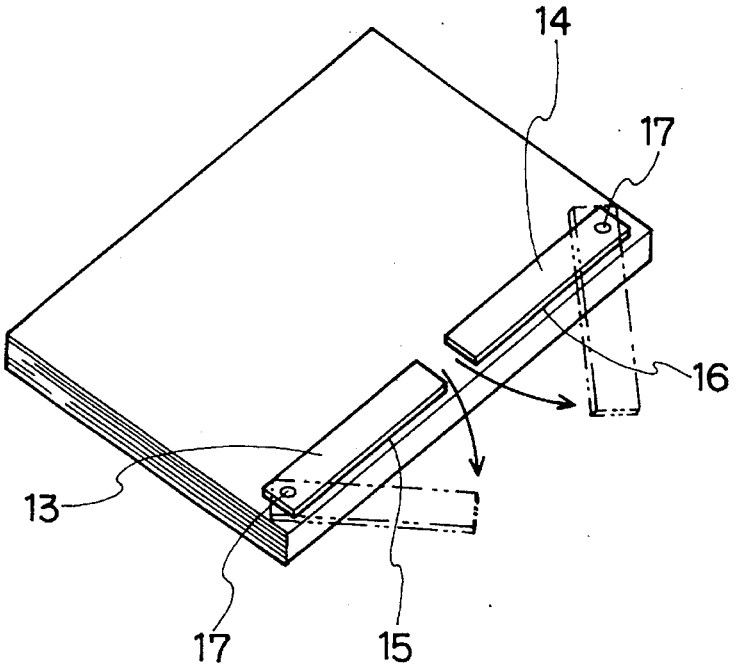
FIG. 5 is a perspective view showing another embodiment of the filing tool of the present invention, respectively.

The switching means using the two brackets 13, 14 can be applied to a type of filing tool 11 shown in Fig. 2. Such an applied filing tool is shown in FIG. 5 as an example.

Figure 6:
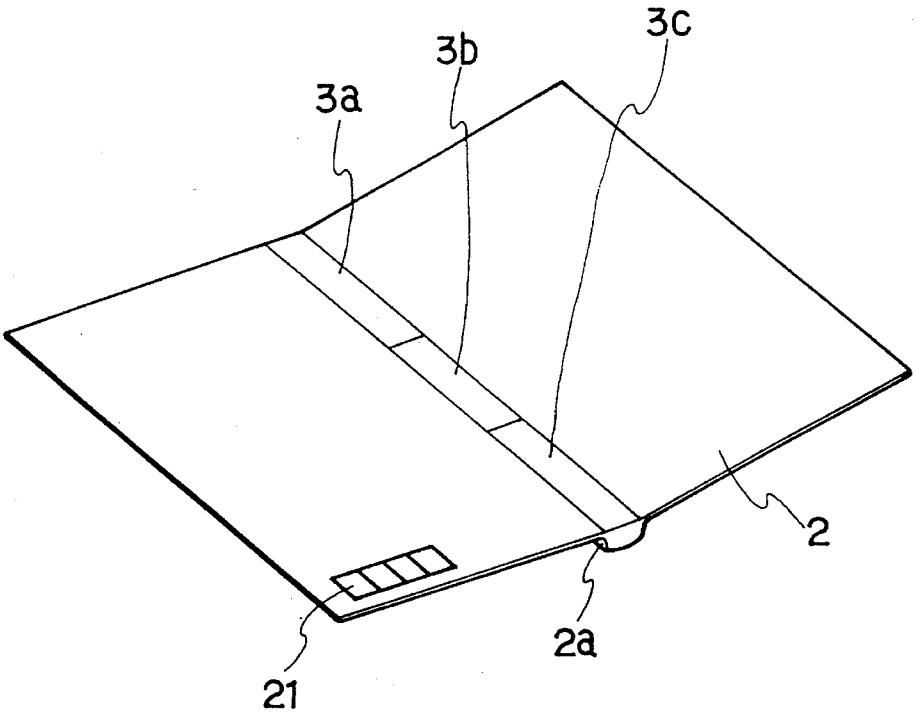
FIG. 6 is a perspective view showing still another embodiment of the filing tool of the present invention.

Besides, the system of changing plural magnetically attracting means can also be applied to the filing tools 1, 11 of FIG. 1 or so using electromagnet 3. For example, the filing tool shown in FIG. 6 comprises three electromagnets, i.e. the upper electromagnet 3*a*, the middle electromagnet 3*b* and the lower electromagnet 3*c*, arranged in the back 2*a* of cover 2 and a selecting switch 21 for selecting an electromagnet to be excited. The number of electromagnets is not limited to three, and two magnets, or four or more magnets can be employed.

Figure 7:
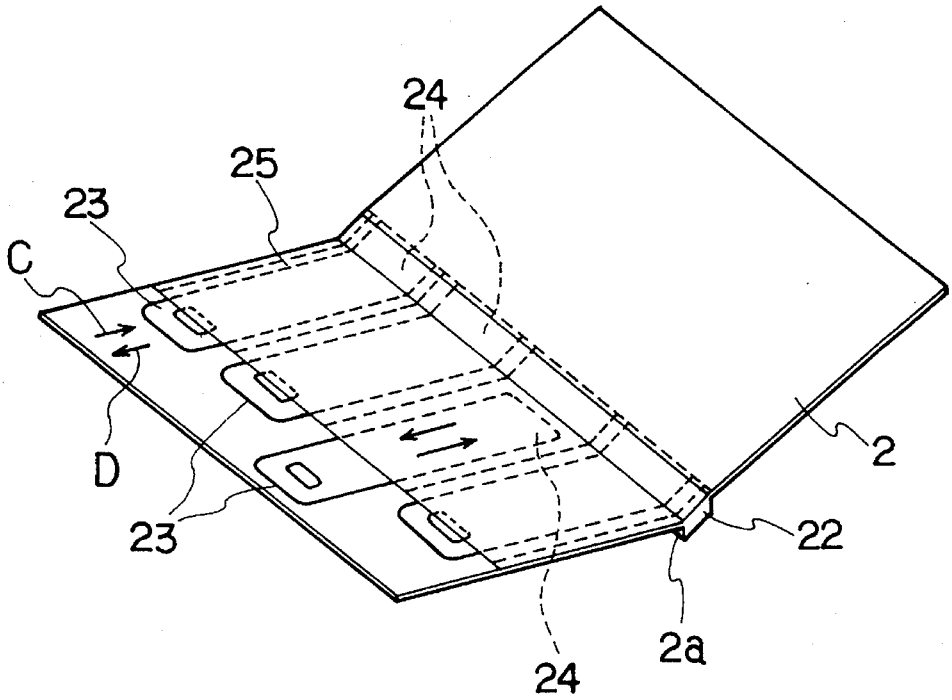
FIG. 7 is a perspective view showing yet another embodiment of the present invention.

FIG. 7 shows another embodiment of excited/non-excited (or strong/weak) switching means in the present invention. This filing tool employs an elongated permanent magnet 22 provided in the back 2*a* of the cover 2 as a magnetically attracting means and employs plural magnet shield sheets 23 covering the upper face of the permanent magnet 22 as a switching means. The magnetic shield sheets 23 are inserted between the cover 2 and the magnetic permeable sheet, e.g. synthetic resin sheet, extending from the inside of the cover 2 to the inside of the back 2*a*. When one of the magnetic shield sheets 23 is pushed in the direction of arrow C, the lines of magnetic force are interrupted by the end portion of the pushed shield sheet 23. And when the shield sheet 23 is pulled in the direction of arrow D, the magnet force acts to the metal band of the paper effectively.

Though four leaves of shield sheets 23 are employed in the embodiment of FIG. 7, a leaf of wide magnetic shield sheet 23 can be employed. Further, two, three, five, or another number of magnetic shield sheets 23 can also be employed so that a magnetically effective portion can be selected (in the case of FIG. 7 four magnetic shield sheets are employed).

Figure 8:
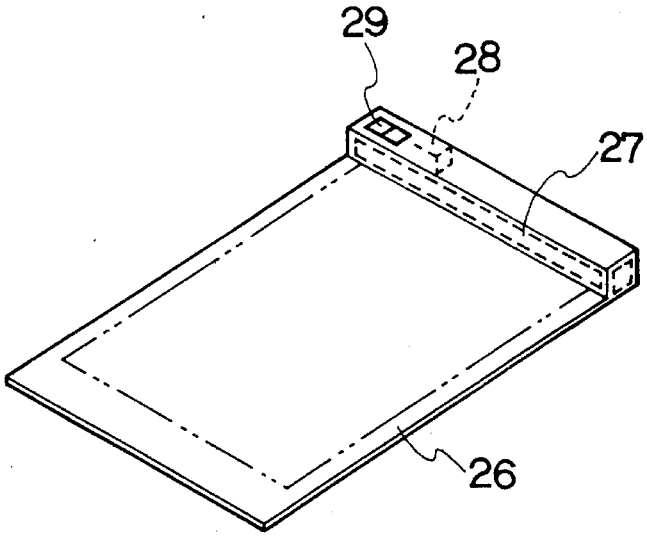
FIG. 8 is a perspective view showing yet another embodiment of the present invention.

Though a two-folded cover 2 is employed in the preceding embodiments as a mount or base board, the present invention is not limited to those cases. For example, as shown in FIG. 8, a mount 26 can be employed as a mount for mounting an electromagnet 27, a cell 28 and a selecting switch 29.

Figure 9:
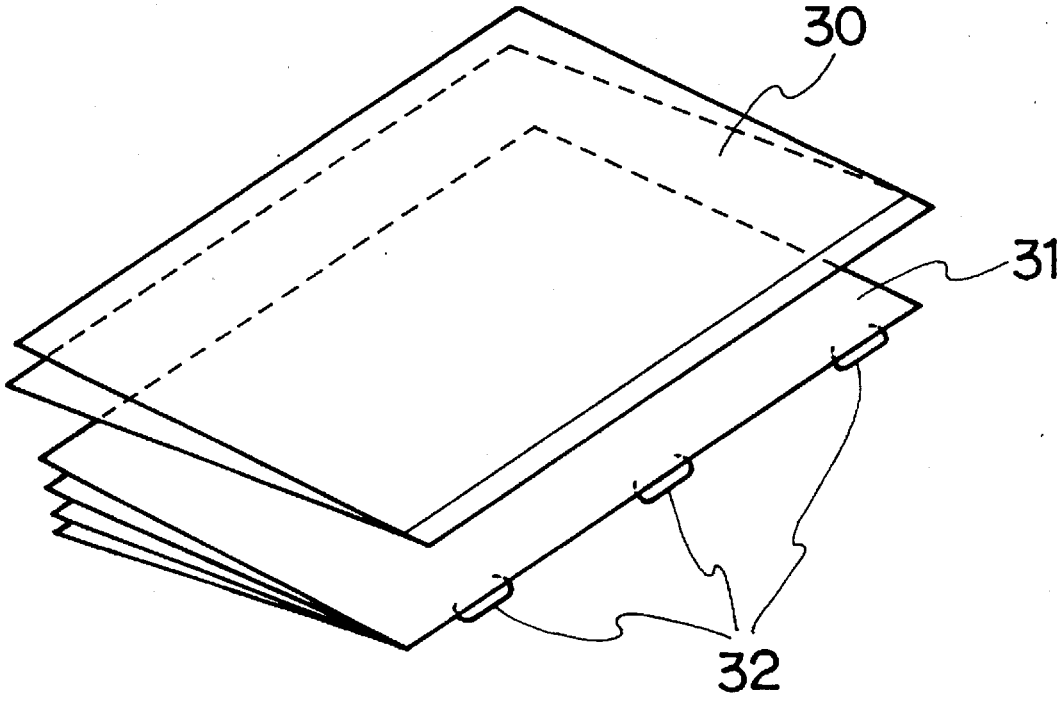
FIG. 9 is a perspective view showing yet another embodiment of the present invention.

Further, in the above mentioned embodiments, each of the magnetically attractable sheets is a leaf of paper. However, as shown in FIG. 9 a two-folded paper or two-folded sheets 31 consisting of two or more or, sheets bound by staples 32 can also be employed as the magnetically attractable sheet. In the latter case, the staples 32 serve the same function as the magnetically attractable band.

Figure 10:
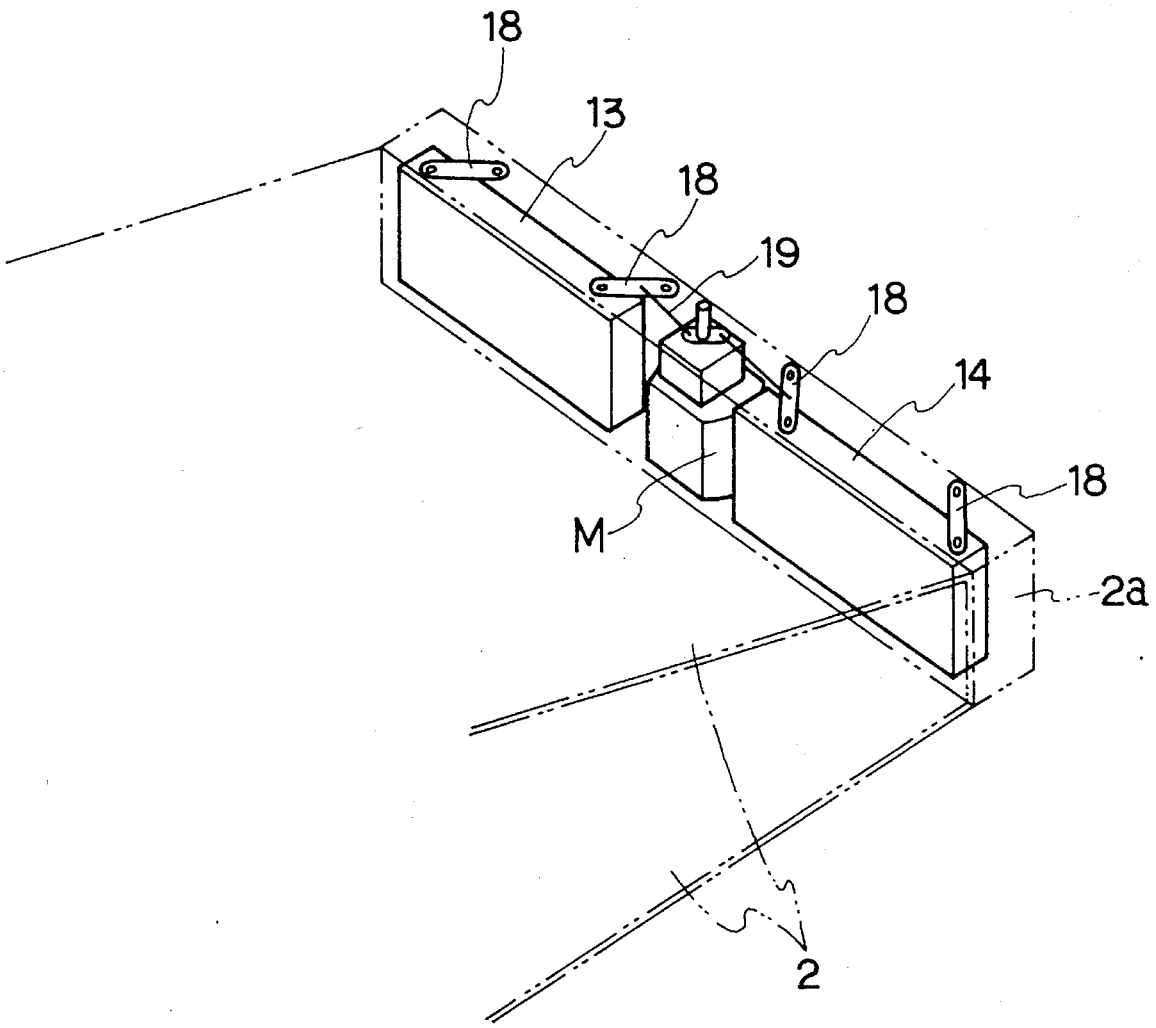
FIG. 10 is a perspective view showing yet another embodiment of the present invention.
Figure 11:
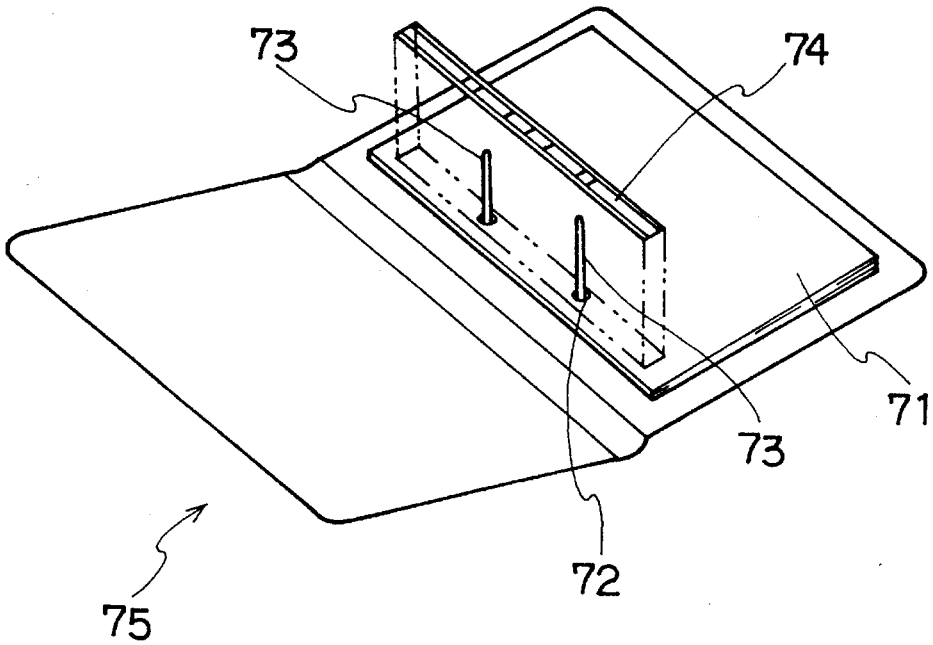
FIG. 11 is a perspective view showing an example of a conventional filing tool.
Figure 12:
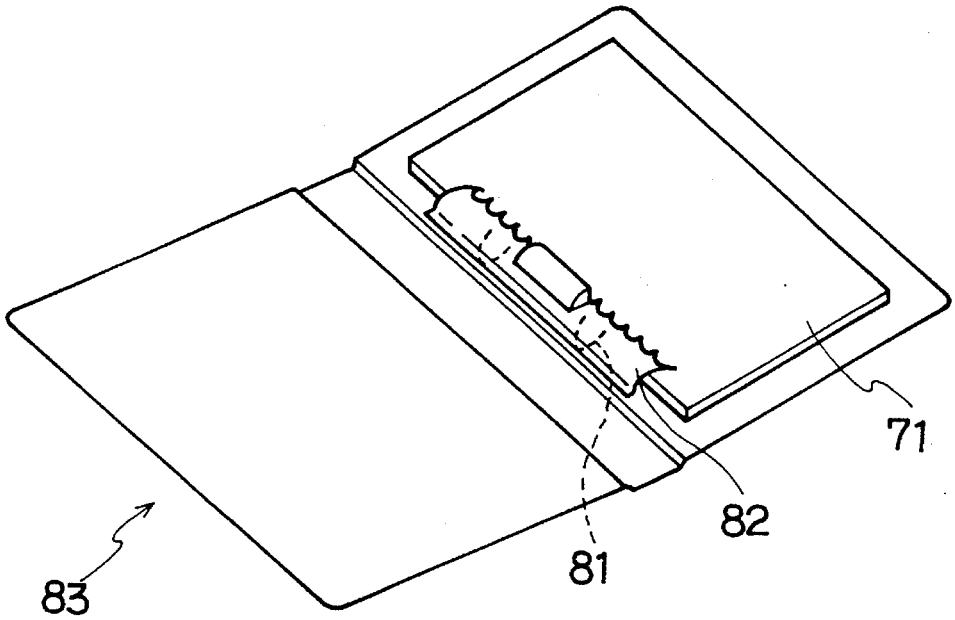
FIG. 12 is a perspective view showing another example of a conventional filing tool.

In the embodiments of FIGS. 3 and 5, the brackets 13 and 14 are rotatably mounted on the cover 2 through pins 17. However, as shown in FIG. 10, the brackets 13, 14 can be attached to the cover through a parallel link mechanism 18, 19, so that the brackets 13, 14 move in parallel with the back 2*a*. In this construction, the open/close motions of the brackets 13, 14 can be driven with a combination of a small electric motor M and a reduction gear 20 or another actuator. If such an actuator is used, the switching operation of excited/non-excited state can be easily performed by operating the select switch or the like. Also in the rotatable brackets 13, 14 of FIGS. 3 and 5, such an electric motor M or another electric actuator can be employed in order to actuate the brackets 13, 14 to open and close.

With respect to the present invention, sheets can be easily filed and detached by operating the switching means for switching the magnetically attracting means between excited and non-excited states together with the magnetically attractable sheet wherein magnetically attractable band is formed on a side end thereof. Further, it is convenient for the filing tool to of an excited/non-excited switching since the switching of the magnetically attracting means can be easily performed by operating the switching means.

With respect to the filing tool having a bracket rotatably mounted on the cover, the bracket being secured with a permanent magnet, or the filing tool utilizing an AC power source, the filed sheets do not become scattered by consuming the cell, so that the sheets can be surely filed for a long time. In the case of the filing tool utilizing an AC power source, it is suitable for such a big filing tool as one not to be carried.

With respect to the filing device which has an electromagnet as a magnetically attracting means and an on-off switch as a switching means, the switching operation is very simple and easy.

With respect to the filing tool which has a cover made of a two-folded magnetic shield sheet as a mount, magnetic field lines of force do not leak to the exterior, such that other devices utilizing magnetism, e.g. magnetic recording card and the like are safely protected.

I claim:

1. A filing tool comprising a magnet and a cover provided with said magnet, wherein said magnet is an electromagnet having a switching means for switching said electromagnet between an excited state and a non-excited states, wherein said cover is made of a two-folded sheet with magnetic shield property capable of shielding against lines of magnetic force around said electromagnet.

2. A filing tool comprising a permanent magnet and a cover provided with said magnet, said magnet being a switching means for switching between an excited state and a non-excited state, said switching means including a bracket detachably connected to said cover, and said magnet being secured to said bracket.

* * * * *